United States Patent [19]

Jones et al.

[11] Patent Number: 4,479,448

[45] Date of Patent: Oct. 30, 1984

[54] NEEDLE POSITIONING ARRANGEMENT IN AN ELECTRONICALLY CONTROLLED HOUSEHOLD SEWING MACHINE

[75] Inventors: Gary D. Jones, Short Hills; Leonard I. Horey, West Orange; Marvin Kurland, East Brunswick; Bruce E. Arnold, Clinton, all of N.J.

[73] Assignee: The Singer Company, Stamford, Conn.

[21] Appl. No.: 550,165

[22] Filed: Nov. 9, 1983

[51] Int. Cl.[3] ..... D05B 69/22

[52] U.S. Cl. ..... 112/275; 112/158 E; 112/266.1

[58] Field of Search ..... 112/275, 277, 220, 221, 112/158 E, 121.11, 262.1, 266.1

[56] References Cited

U.S. PATENT DOCUMENTS 3,622,854 11/1971 Imai et al. .
3,788,250 1/1974 Soeda .
4,262,614 4/1981 Sugaya et al. .
4,331,890 5/1982 Makino ..... 112/277 X
4,351,254 9/1982 Brown .

FOREIGN PATENT DOCUMENTS

WO82/03879 11/1982 PCT Int'l Appl. .

*Primary Examiner*—Peter Nerbun
*Attorney, Agent, or Firm*—David L. Davis; Robert E. Smith; Edward L. Bell

[57] ABSTRACT

An electronically controlled household sewing machine includes an arrangement for needle positioning. The machine responds to a tap of the foot controller for stopping the sewing machine at the next change of state of the armshaft timing signal.

3 Claims, 4 Drawing Figures

NEEDLE POSITIONING ARRANGEMENT IN AN ELECTRONICALLY CONTROLLED HOUSEHOLD SEWING MACHINE

BACKGROUND OF THE INVENTION

This invention relates to household sewing machines and, more particularly, to a needle positioning arrangement incorporated in a household sewing machine.

In household sewing machines, needle positioning is desirable so that the operator may stop the sewing machine with the needle raised in order to remove work material or with the needle lowered in order to pivot work material. Where automatic needle positioning is not provided, the operator must move the handwheel to appropriately position the needle. Systems are known which provide automatic needle positioning in a household sewing machine. These systems typically utilize special needle position sensors and needle position selection switches, both of which add to the cost of the sewing machine.

It is therefore an object of the present invention to provide a needle positioning arrangement in a sewing machine without adding additional components which increase the cost of the sewing machine.

SUMMARY OF THE INVENTION

The foregoing and additional objects are attained in accordance with the principles of this invention by providing an electronically controlled sewing machine arranged to provide the needle positioning function without any additional hardware dedicated to that function. The sewing machine includes stitch forming instrumentalities positionally controlled over a predetermined range between stitches to produce a pattern of feed and bight controlled stitches, means for storing pattern stitch information in an ordered sequence corresponding to the sequence of stitches within the pattern, means for generating timing pulses in timed relation with the operation of the sewing machine, means responsive to the timing pulses for extracting the pattern stitch information from the storing means, actuating means responsive to the extracted pattern stitch information for influencing the feed and bight motions of the stitch forming instrumentalities to produce a pattern of stitches corresponding to the extracted pattern stitch information, a motor for driving the sewing machine to produce endwise reciprocation of the sewing machine needle and feeding motion for the sewing machine feed mechanism, an operator actuable controller for providing a signal corresponding to an operator desired motor speed, and motor control means responsive to the signal for controlling the operation of the motor. According to this invention, an arrangement cooperating with the motor control means for controlling the motor to position the sewing machine needle at a predetermined position within its range of reciprocatory movement comprises means responsive to the initiation of a signal from the controller for causing the motor to run at a first speed, a timer, means responsive to the signal initiation for actuating the timer, means responsive to termination of the signal for interrogating the timer, means responsive to the timed interval being greater than responsive to the timed interval being less than the predetermined time for allowing the motor to run at the first speed until a timing pulse is sensed and then stopping the motor. Thus, the sewing machine responds to a "tap" of the controller for utilizing the timing pulses to position the needle.

BRIEF DESCRIPTION OF THE DRAWINGS

The foregoing will be more readily apparent upon reading the following description in conjunction with the drawings wherein.

DETAILED DESCRIPTION

Figure 1:
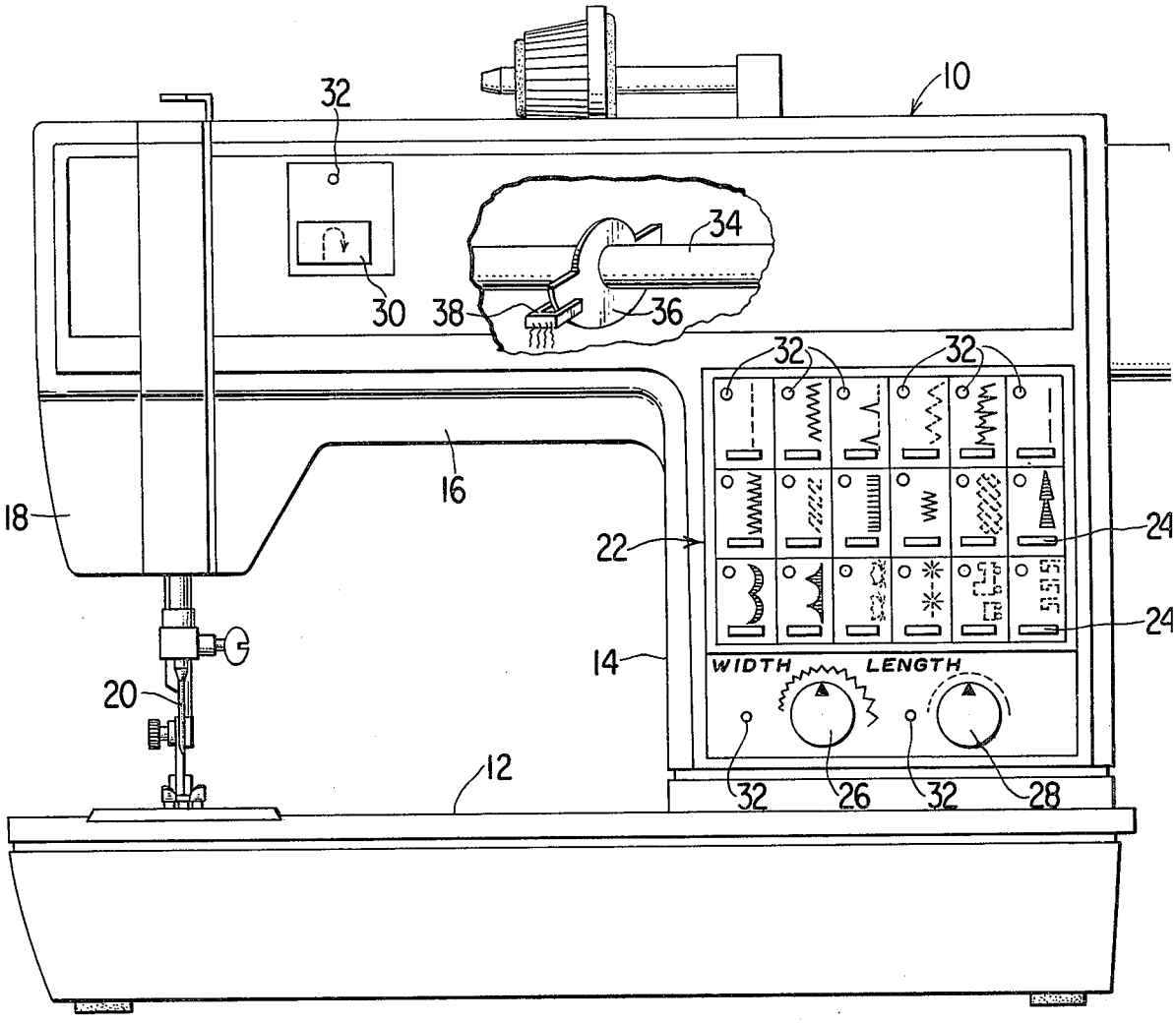
FIG. 1 is a front elevational view, partially cut away, of an illustrative sewing machine in which this invention may be incorporated.

Referring now to the drawings, wherein like elements in different figures thereof have the same reference character applied thereto, FIG. 1 shows a sewing machine designated generally by the reference numeral 10. The sewing machine 10 includes a work supporting bed 12, a standard 14, a bracket arm 16 and a sewing head 18. The sewing machine stitch forming instrumentalities include a needle 20 capable of being endwise reciprocated and laterally jogged to form zig zag stitches and a work feed dog (not shown) operating upwardly through slots formed in a throat plate formed on the bed 12 to transport the work across the bed 12 between needle penetrations. The pattern of stitches produced by operation of the sewing machine, i.e., the positional coordinates of each stitch penetration, may be influenced, for example, by data stored in a memory unit and extracted in timed relation with the operation of the sewing machine, as is well known in the art.

On the front panel of the sewing machine 10 there is provided an input means whereby the operator can effect control of the functions of the sewing machine. This input means includes switches and dials whereby the operator may select a pattern to be sewn by the sewing machine as well as effecting modifications to the pattern. Pattern selection is effected illustratively through an array 22 of pushbutton switches 24, each of which corresponds to a pattern of stitches the information for forming which is stored within the memory of the sewing machine 10. Associated with each of the pushbutton switches 24 is a pictorial representation of the pattern as it would be sewn by the sewing machine upon actuation of that switch. The input means also includes a stitch width control (bight override) 26 and a stitch length control (feed override) 28. The controls 26 and 28 each includes a pushbutton switch which is operator actuated to effect the respective width or length modification and includes a rotary portion for setting the magnitude of the modification. A pushbutton switch 30 is also provided for reverse sewing. Indicating means for indicating to an operator the status of each of the various functions which may be selected is also provided on the front panel of the sewing machine 10. Illustratively, this takes the form of a plurality of light emitting diodes (LED's) 32 each in close proximity to its respective input switch.

The sewing machine 10 also includes an arrangement for generating timing pulses in timed relation with the operation of the sewing machine. As is well known in the art, the horizontal armshaft 34 revolves once for each penetration of the work material by the needle 20.

Suitably mounted on the armshaft 34 is a timing disc 36 and supported on the frame of the sewing machine is an optical assembly 38 which straddles the optical disc 36. The optical assembly 38 includes a light source and a light detector, as is well known. The optical disc 36 is formed so that the light detector is shielded from the light source for approximately 180° of the rotation of the armshaft 34 and is exposed to the light source for the remaining approximately 180° of rotation. The angular position of the disc 36 with respect to the armshaft 34 is such that the optical assembly 38 is in one state from substantially a needle up position to a needle down position, and in a second state from substantially a needle down position to the needle up position. The change of state of the optical assembly 38 at needle up or needle down is utilized to indicate a release of bight information or of feed information from the memory in the sewing machine. According to the present invention, there is provided an arrangement for utilizing the output of the optical assembly 38 to permit the sewing machine 10 to be stopped with the needle 20 either up or down, as will be described in full detail hereinafter.

Figure 2:
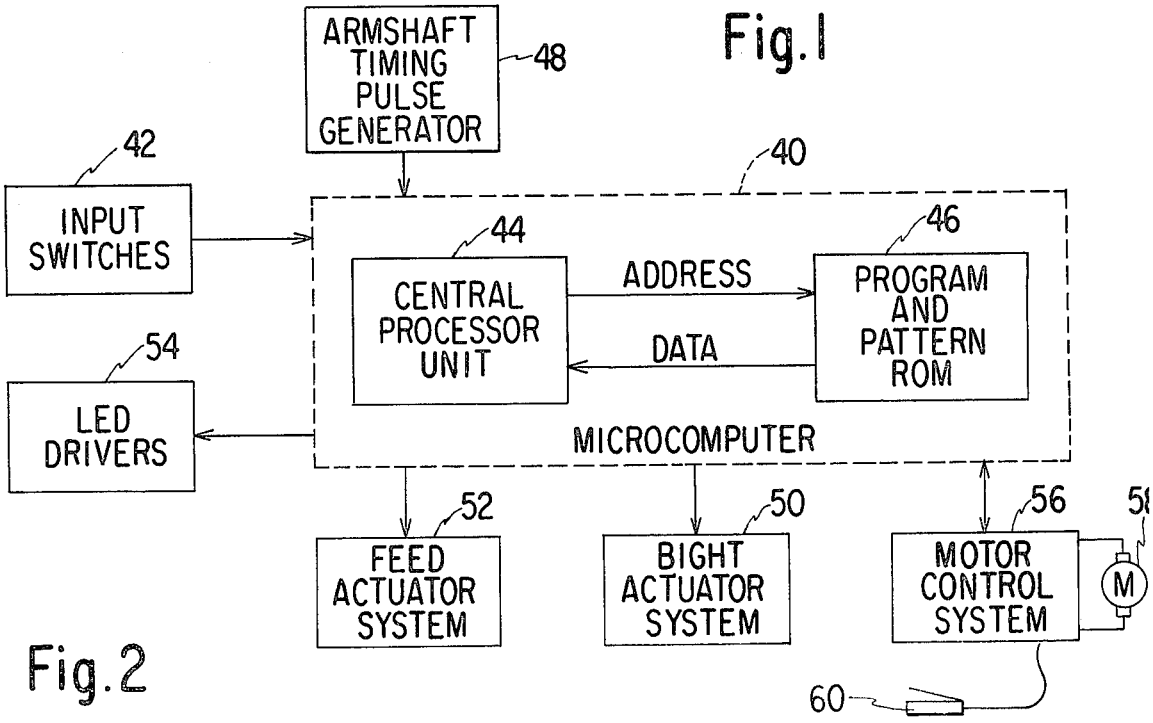
FIG. 2 illustrates a general block diagram of a microcomputer based control system for the sewing machine of FIG. 1.

FIG. 2 shows a general block diagram of a microcomputer based controller for an electronic stitch pattern sewing machine, which controller may be utilized to control the operation of the sewing machine 10 (FIG. 1) and which operates in accordance with the principles of this invention. Accordingly, the microcomputer 40 receives input signals from the input switches 42 indicative of the functions the sewing machine operator desires to be performed by the sewing machine. The input switches 42 may include the pattern selection switches 24 as well as the function switches 26–30. The microcomputer 40 includes an internal central processor unit (CPU) 44 and a program and pattern ROM 46. The CPU 44 obtains from the ROM 46, in timed relation with the operation of the sewing machine, as determined by signals received from the armshaft timing pulse generator 48 (which includes the optical assembly 38), pattern data for controlling the bight actuator system 50 and the feed actuator system 52. The bight actuator system 50 and the feed actuator system 52 are similar in construction and are adapted to covert a digital code word from the microcomputer 40 into a mechanical position which locates the sewing machine needle in a conventional stitch forming instrumentality and provides a specific work feed for each needle penetration, respectively, as is well known in the art. The microcomputer 40 also provides signals to the LED drivers 54 to control the illumination of the LED's 32 (FIG. 1) to indicate the function selected by the sewing machine operator.

Also shown in FIG. 2 is a motor control system 56 which functions to control the operation of the sewing machine drive motor 58. As is well known in the sewing machine art, the motor 58 drives the sewing machine 10 to produce endwise reciprocation of the needle 20 through the armshaft 34 and to produce feeding motion for the sewing machine feed mechanism. Illustratively, the motor control system 56 may itself be a programmed microcomputer. In any event, the motor control system 56 communicates with the microcomputer 40 and may be controlled by the microcomputer 40 such as, for example, to prevent the sewing machine from operating or to limit the speed at which the sewing machine can be operated or even to operate the sewing machine without operator intervention. During normal sewing, the motor control system 56 operates the sewing machine motor 58 in accordance with operator commands received from, for example, a foot controller 60. Illustratively, the motor control system 56 communicates with the microcomputer 40 by providing a signal to the microcomputer 40 indicating that the foot controller 60 is depressed. The microcomputer 40 communicates with the motor control system 56 by providing signals indicative of a predetermined time for stopping the motor, and means the maximum speed at which the motor control system 56 should allow the motor 58 to run. Furthermore, the motor control system 56 is designed to operate such that when it recognizes a specific speed signal, illustratively 70 RPM, it interprets this speed signal as the needle positioning speed and runs without the benefit of a command from the foot control 60. Furthermore, the motor control system 56 is arranged so that it always starts the motor 58 at this speed (i.e., 70 RPM) so that in case the operator merely taps the foot control 60, the microcomputer 40 has sufficient time to discriminate this tap as a request for needle positioning before the motor 58 has an opportunity to accelerate to full speed.

Figure 3A:
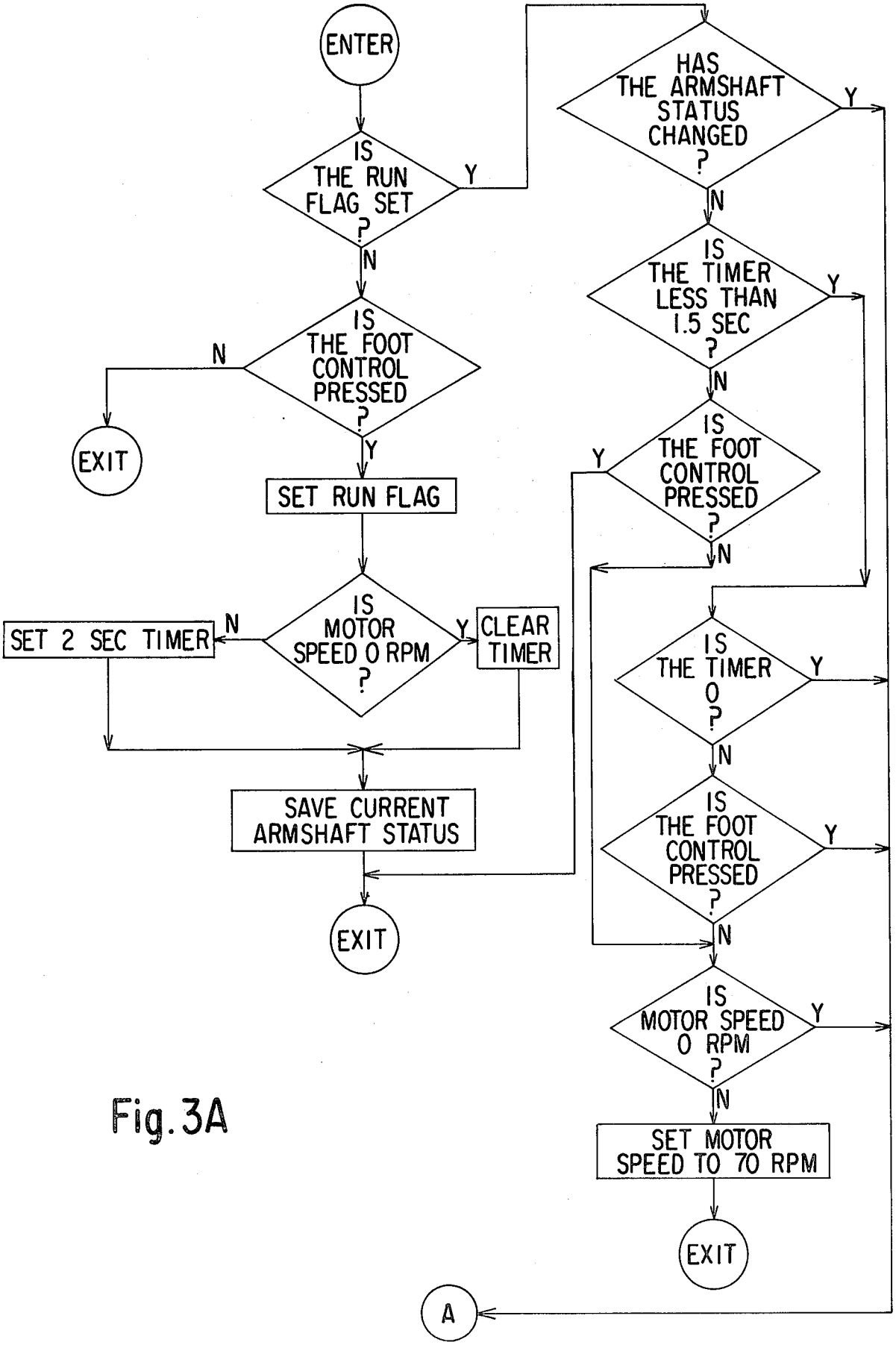
FIGS. 3A and 3B together form a flow chart of a subroutine for operating the microcomputer of FIG. 2 in accordance with the principles of this invention.
Figure 3B:
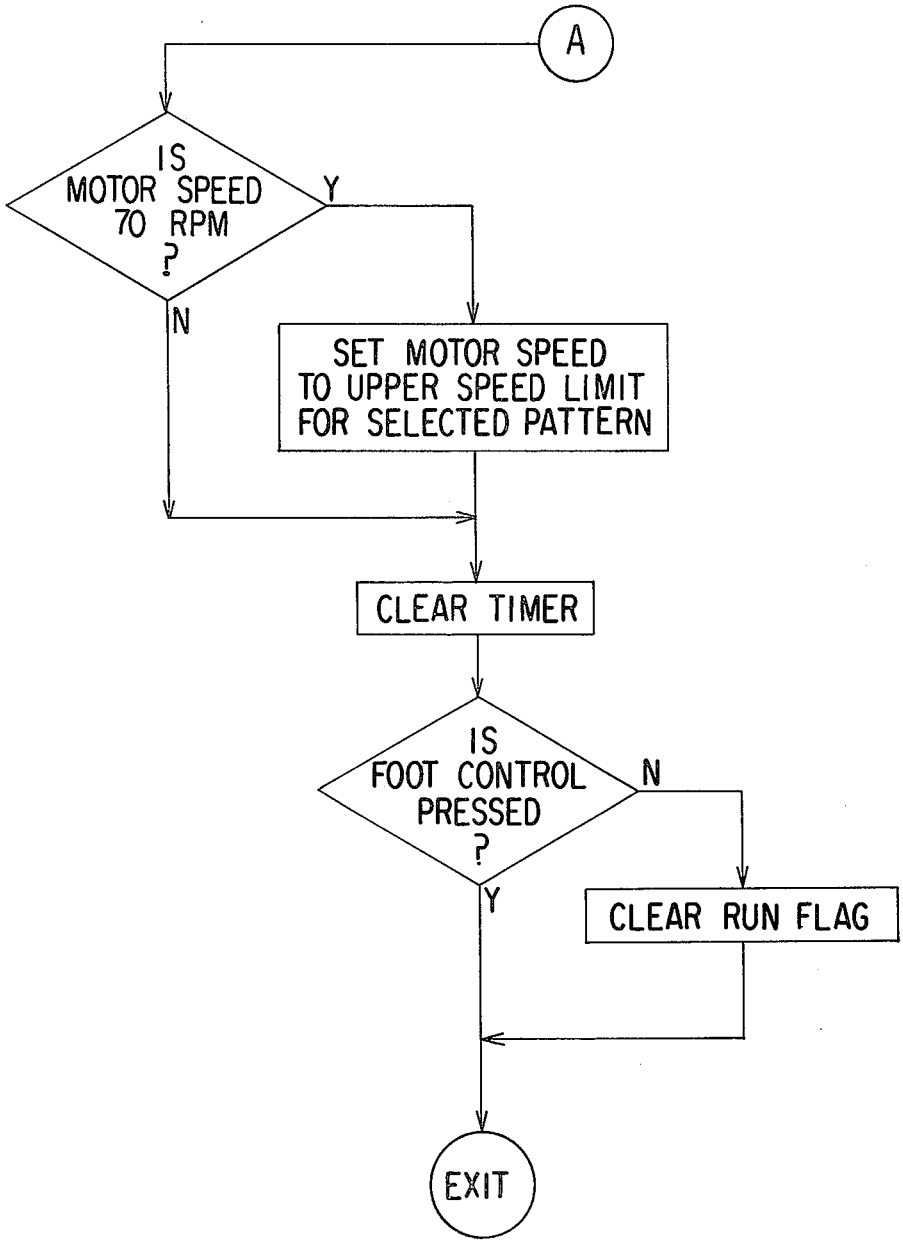

FIGS. 3A and 3B together form a flow chart of a subroutine for the microcomputer 40 which responds to signals from the motor control system 56 as to whether or not the foot control 60 is actuated in order to provide signals back to the motor control system 56 which instruct the motor control system whether the motor 58 should be run and if so at what maximum speed. In particular, the subroutine set forth in FIGS. 3A and 3B provides the function of discriminating a tap of the foot control 60, defined as an actuation of the foot control 60 for not more than 0.5 seconds, to cause the motor control system to stop the motor at the next change of state of the armshaft timing pulse generator 48. Thus, according to the present invention, during normal operation of the sewing machine it stops at a random position. In order to position the needle, the foot control 60 is tapped by the operator, which tap is defined as a depression for less than ½ second. When the foot control 60 is depressed, the sewing machine always starts at a slow speed regardless of how far the foot control 60 is depressed. This slow-start occurs for the first ½ second of every start-up, and provides the necessary time for the system logic to identify a tap. Otherwise, the machine would accelerate beyond needle positioning speed before the tap could be recognized. When the tap is recognized, the machine is run at needle positioning speed (approximately 70 RPM) until the next armshaft change of state signal is received. This may be needle up or needle down, depending on the present stop position. If an armshaft change of state signal is not received within a specified time limit, illustratively two seconds, the machine is automatically stopped.

As shown in the flow chart of FIGS. 3A and 3B, the microcomputer 40 has a RUN flag which is set by the microcomputer 40 whenever the motor control system 56 is to cause the motor 58 to run. Additionally, a MOTOR SPEED signal is provided by the microcomputer 40 to the motor control system 56 which indicates the maximum speed at which the motor control system 56 is to allow the motor 58 to run. This maximum speed is typically determined by which pattern is selected by the operator, each pattern having stored in the ROM 46 an upper speed limit associated therewith. However, at every start-up of the motor, the motor speed is set to a low value, illustratively 70 RPM. This speed is also utilized for needle positioning, in which case the motor control system 56 allows the motor 58 to run at that speed although the operator has released the foot control 60. Normally, when the operator releases the foot control 60, the RUN flag is cleared. However, when the microcomputer 40 recognizes a tap of the foot control 60, it keeps the RUN flag set although the operator has released the foot control 60 until such time as an armshaft change of state signal is sensed. At this time, the RUN flag is cleared. The motor control system 56 is designed to keep the motor 58 running until the RUN flag is cleared. Therefore, the sewing machine continues to operate until there is a pulse from the armshaft timing pulse generator 48. When this occurs, the RUN flag is cleared and the motor control system 56 stops the motor 58 to stop the sewing machine 10 with the needle either up or down, depending upon where it had been when the machine was first started. Thus, a sequence of taps of the foot control 60 will cause the sewing machine to position the needle 20 alternately up and down. As a modification to the above-described operation, the motor control system 56 may be designed to stop the sewing machine at some preset angular position after the RUN flag is cleared, in order to provide for more precise positioning.

Accordingly, there has been disclosed a needle positioning arrangement in an electronically controlled household sewing machine which does not require any additional dedicated hardware. It is understood that the above-described embodiment is merely illustrative of the application of the principles of this invention. Numerous other embodiments may be devised by those skilled in the art without departing from the spirit and scope of this invention, as defined by the appended claims. For example, although a programmed microcomputer has been disclosed, this invention may also be practiced with a hard wired processor. Furthermore, it is also contemplated that this invention may be practiced in other than an electronic stitch pattern sewing machine. In such case, the sewing machine would need to be equipped with the equivalent of the armshaft timing pulse generator so that two signals are provided, spaced substantially 180° apart. The motor control system would be arranged to always start the motor at a slow speed in response to operator actuation of the controller so that a tap may be discriminated before the motor accelerates to full speed.

We claim:

1. In an electronically controlled sewing machine having stitch forming instrumentalities positionally controlled over a predetermined range between stitches to produce a pattern of feed and bight controlled stitches; means for storing pattern stitch information in an ordered sequence corresponding to the sequence of stitches within the pattern; means for generating timing pulses in timed relation with the operation of said sewing machine; means responsive to said timing pulses for extracting said pattern stitch information from said storing means; actuating means responsive to said extracted pattern stitch information for influencing the feed and bight motions of said stitch forming instrumentalities to produce a pattern of stitches corresponding to said extracted pattern stitch information; a motor for driving said sewing machine to produce endwise reciprocation of the sewing machine needle and feed motion for the sewing machine feed mechanism; an operator actuable controller for providing a signal corresponding to an operator desired motor speed; and motor control means responsive to said signal for controlling the operation of said motor; an arrangement cooperating with said motor control means for controlling said motor to position the sewing machine needle at a predetermined position within its range of reciprocatory movement comprising:

means responsive to the initiation of a signal from said controller for causing said motor to run at a first speed;

a timer;

means responsive to said signal initiation for actuating said timer;

means responsive to termination of said signal when the timed interval is greater than a predetermined time for stopping the motor;

means responsive to termination of said signal when the timed interval is less than said predetermined time for maintaining running of the motor at said first speed until a timing pulse is sensed and then stopping the motor; and means responsive to the timed interval being greater than a second predetermined time in the absence of a timing pulse for stopping the motor.

2. In a sewing machine having a motor for driving said sewing machine to produce endwise reciprocation of the sewing machine needle and feeding motion for the sewing machine feed mechanism; means for generating timing pulses in timed relation with the operation of said sewing machine; an operator actuable speed controller for providing a signal corresponding to an operator desired motor speed; and motor control means responsive to said signal for controlling the operation of said motor; a method for controlling said motor to position the sewing machine needle at a predetermined position within its range of reciprocatory movement comprising the steps of:

(a) responding to operator actuation of the speed controller to cause the motor to run;

(b) responding to operator release of the controller to discriminate whether the actuation time of the controller was above or below a first predetermined time;

(c) stopping the motor if the actuation time was above said first predetermined time;

(d) waiting for a timing pulse and then stopping the motor if the actuation time was below said first predetermined time; and (e) stopping the motor a second predetermined time after operator actuation of the speed controller in the event a timing pulse is not received when the actuation time was below said first predetermined time.

3. The method according to claim 2 wherein step (a) includes running the motor at no more than a predetermined speed for said first predetermined time after operator actuation of the speed controller.

* * * * *